US009468939B2

(12) United States Patent
Hanna et al.

(10) Patent No.: US 9,468,939 B2
(45) Date of Patent: Oct. 18, 2016

(54) FACEPLATE FOR SHOWER DEVICE

(71) Applicant: Kohler Co., Kohler, WI (US)

(72) Inventors: Kenneth S. Hanna, Bellingham, WA (US); Jeffrey A. Schumacher, Port Washington, WI (US); Gregory de Swarte, Sheboygan, WI (US); Leila M. Rubin, New York, NY (US)

(73) Assignee: Kohler Co., Kohler, WI (US)

( * ) Notice: Subject to any disclaimer, the term of this patent is extended or adjusted under 35 U.S.C. 154(b) by 592 days.

(21) Appl. No.: 13/790,621

(22) Filed: Mar. 8, 2013

(65) Prior Publication Data

US 2013/0232684 A1 Sep. 12, 2013

Related U.S. Application Data

(60) Provisional application No. 61/609,793, filed on Mar. 12, 2012.

(51) Int. Cl.

| | |
|---|---|
| ***A47K 3/00*** | (2006.01) |
| ***B05B 1/18*** | (2006.01) |
| ***B05B 1/30*** | (2006.01) |
| *E03C 1/06* | (2006.01) |

(52) U.S. Cl.

CPC ..... *B05B 1/185* (2013.01); *B05B 1/30* (2013.01); *B05B 1/18* (2013.01); *E03C 1/06* (2013.01)

(58) Field of Classification Search

CPC ..... B05B 1/18
USPC ..... 4/567–570, 615–618; 239/548, 239/558–561, 567, 600; 29/890.141–890.143
See application file for complete search history.

(56) References Cited

U.S. PATENT DOCUMENTS

| | | | |
|---|---|---|---|
| 3,088,675 | A | 5/1963 | Bone |
| 3,608,650 | A | 9/1971 | Matsusaka |

(Continued)

FOREIGN PATENT DOCUMENTS

| | | | |
|---|---|---|---|
| CN | 1761528 | A | 4/2006 |
| CN | 202045027 | U | 11/2011 |

(Continued)

OTHER PUBLICATIONS

United States Patent Office Notice of Allowance for U.S. Appl. No. 29/470,413 dated Jan. 31, 2014 (16 pages).

(Continued)

*Primary Examiner* — Paul R. Durand
*Assistant Examiner* — Nicholas Ros
(74) *Attorney, Agent, or Firm* — Michael Best & Friedrich LLP

(57) ABSTRACT

A shower device and a faceplate assembly for a shower device. The faceplate assembly may include a faceplate having a front surface and a rear surface, a plurality of apertures being defined between the front surface and the rear surface, the faceplate being at least partially formed of a transparent material proximate the front surface, and an opaque material located proximate the rear surface. A pattern may be formed from facets, adjacent facets meeting at an intersection, at least one of the plurality of apertures being positioned at an intersection. A shower device may include a nozzle plate having a surface and including a plurality of nozzles for discharging water, at least one of the plurality of nozzles having a barb; and a faceplate snap-fit to the nozzle plate by the barb.

36 Claims, 5 Drawing Sheets

(56) References Cited

U.S. PATENT DOCUMENTS

| | | | | |
|---|---|---|---|---|
| 3,944,140 | A | 3/1976 | Caton et al. | |
| 3,963,179 | A | 6/1976 | Tomaro | |
| 4,272,022 | A * | 6/1981 | Evans | B05B 1/18 239/107 |
| D267,581 | S | 1/1983 | Mackay et al. | |
| 4,545,083 | A | 10/1985 | Searson | |
| 4,561,593 | A | 12/1985 | Cammack et al. | |
| 4,618,100 | A | 10/1986 | White et al. | |
| 4,733,818 | A | 3/1988 | Aghnides | |
| 4,733,819 | A | 3/1988 | Aghnides | |
| 4,964,181 | A | 10/1990 | Alpert | |
| 4,998,673 | A | 3/1991 | Pilolla | |
| 5,215,258 | A | 6/1993 | Jursich | |
| 5,228,652 | A | 7/1993 | Ponticelli et al. | |
| 5,329,650 | A | 7/1994 | Zaccai et al. | |
| 5,405,089 | A * | 4/1995 | Heimann et al. | 239/533.14 |
| 5,518,181 | A | 5/1996 | Shames et al. | |
| 5,535,779 | A | 7/1996 | Huang | |
| 5,664,015 | A | 9/1997 | Ford et al. | |
| 5,702,057 | A | 12/1997 | Huber | |
| 5,730,362 | A | 3/1998 | Cordes | |
| 5,779,146 | A * | 7/1998 | Cutler | 239/71 |
| 5,862,985 | A | 1/1999 | Neibrook et al. | |
| 6,021,960 | A | 2/2000 | Kehat | |
| D423,083 | S | 4/2000 | Haug et al. | |
| D424,160 | S | 5/2000 | Haug et al. | |
| D424,161 | S | 5/2000 | Haug et al. | |
| D424,162 | S | 5/2000 | Haug et al. | |
| D424,163 | S | 5/2000 | Haug et al. | |
| D424,164 | S | 5/2000 | Haug et al. | |
| 6,061,457 | A | 5/2000 | Stockhamer | |
| D428,110 | S | 7/2000 | Haug et al. | |
| 6,090,210 | A | 7/2000 | Ballance et al. | |
| 6,126,290 | A | 10/2000 | Veigel | |
| D439,305 | S | 3/2001 | Slothower | |
| D440,277 | S | 4/2001 | Slothower | |
| D440,278 | S | 4/2001 | Slothower | |
| D443,027 | S | 5/2001 | Kollmann et al. | |
| D443,029 | S | 5/2001 | Kollmann et al. | |
| 6,263,524 | B1 * | 7/2001 | Abdul | 4/615 |
| D457,598 | S | 5/2002 | Storti et al. | |
| 6,439,472 | B1 | 8/2002 | Lin et al. | |
| 6,444,039 | B1 | 9/2002 | Nguyen | |
| 6,463,658 | B1 * | 10/2002 | Larsson | B05B 1/185 29/451 |
| D465,263 | S | 11/2002 | Tse | |
| D465,551 | S | 11/2002 | Tse | |
| D466,188 | S | 11/2002 | Tse | |
| D489,793 | S | 5/2004 | Haug et al. | |
| D492,004 | S | 6/2004 | Haug et al. | |
| D492,006 | S | 6/2004 | Haug et al. | |
| D492,008 | S | 6/2004 | Haug et al. | |
| D495,776 | S | 9/2004 | Blomstrom | |
| D497,974 | S | 11/2004 | Haug et al. | |
| D498,514 | S | 11/2004 | Haug et al. | |
| 6,879,818 | B2 | 4/2005 | Wageneck | |
| D506,924 | S | 7/2005 | Berner | |
| D509,424 | S | 9/2005 | Berner | |
| D511,809 | S | 11/2005 | Haug et al. | |
| D513,525 | S * | 1/2006 | Haug et al. | D23/223 |
| 6,983,898 | B2 | 1/2006 | Clark | |
| 7,048,210 | B2 * | 5/2006 | Clark | 239/548 |
| 7,100,845 | B1 | 9/2006 | Hsieh | |
| 7,111,798 | B2 | 9/2006 | Thomas et al. | |
| 7,178,746 | B2 | 2/2007 | Gross | |
| D551,737 | S | 9/2007 | Haug et al. | |
| 7,269,862 | B2 | 9/2007 | Rooke et al. | |
| D557,763 | S | 12/2007 | Schönherr et al. | |
| D557,764 | S | 12/2007 | Schönherr et al. | |
| D557,765 | S | 12/2007 | Schönherr et al. | |
| D562,937 | S | 2/2008 | Schönherr et al. | |
| D562,938 | S | 2/2008 | Blessing | |
| D564,067 | S * | 3/2008 | Lammel | D23/223 |
| D576,251 | S | 9/2008 | Schoenherr et al. | |
| D590,477 | S | 4/2009 | Schoenherr et al. | |
| D590,916 | S | 4/2009 | Schoenherr et al. | |
| D590,917 | S | 4/2009 | Schoenherr et al. | |
| D592,276 | S | 5/2009 | Schoenherr et al. | |
| 7,578,453 | B1 | 8/2009 | Wilson | |
| 7,740,186 | B2 | 6/2010 | Macan et al. | |
| 7,762,479 | B2 | 7/2010 | Li | |
| D630,706 | S | 1/2011 | Giggs et al. | |
| 7,918,408 | B2 | 4/2011 | Tshieh | |
| D638,100 | S | 5/2011 | Juan | |
| 7,946,512 | B2 | 5/2011 | Schorn | |
| 8,028,935 | B2 | 10/2011 | Leber | |
| 8,048,010 | B2 | 11/2011 | Ohashi et al. | |
| D692,527 | S | 10/2013 | Hanna et al. | |
| D707,329 | S | 6/2014 | Hanna et al. | |
| 2003/0029936 | A1 | 2/2003 | Clark | |
| 2004/0164184 | A1 | 8/2004 | Glunk | |
| 2004/0217209 | A1 | 11/2004 | Bui | |
| 2004/0250851 | A1 | 12/2004 | Clark | |
| 2004/0251323 | A1 | 12/2004 | Clark | |
| 2004/0252422 | A1 | 12/2004 | Talbot et al. | |
| 2005/0156062 | A1 | 7/2005 | Thomas et al. | |
| 2006/0175437 | A1 | 8/2006 | Gross | |
| 2007/0246577 | A1 | 10/2007 | Leber | |
| 2008/0011880 | A1 | 1/2008 | Butzke et al. | |
| 2008/0225517 | A1 | 9/2008 | Clark | |
| 2009/0114743 | A1 | 5/2009 | Thomas et al. | |
| 2010/0037389 | A1 | 2/2010 | Gross | |
| 2010/0065665 | A1 | 3/2010 | Whitaker et al. | |
| 2010/0167551 | A1 | 7/2010 | DeDontney | |
| 2011/0031331 | A1 | 2/2011 | Klicpera | |
| 2011/0073678 | A1 | 3/2011 | Qiu et al. | |
| 2011/0139905 | A1 | 6/2011 | Chen et al. | |
| 2012/0104114 | A1 * | 5/2012 | Zhou et al. | 239/71 |
| 2013/0126646 | A1 | 5/2013 | Wu | |

FOREIGN PATENT DOCUMENTS

| | | |
|---|---|---|
| CN | 203408809 U | 1/2014 |
| DE | 10108248 | 8/2002 |
| EP | 0348359 | 12/1989 |
| EP | 0435030 A2 | 7/1991 |
| EP | 1479445 | 11/2004 |
| EP | 2638972 | 9/2013 |
| GB | 2337471 | 11/1999 |
| WO | 97/10841 | 5/1997 |

OTHER PUBLICATIONS

Examination Report from the Canadian Intellectual Property Office for Application No. 2,808,941 dated Mar. 11, 2015 (5 pages).
Office Action from the United States Patent and Trademark Office for U.S. Appl. No. 14/080,432 dated Apr. 30, 2015 (40 pages).
European Patent Office Search Report for Application No. 13193218.8 dated Apr. 17, 2014 (7 pages).
United States Patent Office Notice of Allowance for U.S. Appl. No. 29/450,323 dated Jun. 26, 2014 (8 pages).
United States Patent Office Notice of Allowance for U.S. Appl. No. 29/450,310 dated Jun. 25, 2014 (8 pages).
United States Patent Office Notice of Allowance for U.S. Appl. No. 29/450,306 dated Jun. 26, 2014 (8 pages).
VS-3014 Caspian Showerhead, downloaded Jun. 27, 2014 http://www.speakmancompany.com/products/detail/VS-3014 (1 page).
Grohe Power & Soul, 2013 (5 pages).
EP13158845.1 Extended European Search Report dated May 24, 2013 (7 pages).
Australian Patent Office Examination Report for Application No. 2013201441 dated Sep. 17, 2014 (5 pages).
Extended European Search Report for Application No. 13193218.8 dated Aug. 27, 2014 (14 pages).
United States Patent Office Notice of Allowance for U.S. Appl. No. 29/465,138 dated Aug. 5, 2014 (8 pages).
Shower head photos, known at least as early as Mar. 12, 2012.
Co-pending U.S. Appl. No. 29/450,323, filed Mar. 16, 2013.
Co-pending U.S. Appl. No. 29/450,310, filed Mar. 15, 2013.
Co-pending U.S. Appl. No. 29/450,306, filed Mar. 15, 2013.

(56) References Cited

OTHER PUBLICATIONS

Co-pending U.S. Appl. No. 29/457,990, filed Jun. 14, 2013.
United States Patent Office Notice of Allowance for U.S. Appl. No. 29/415,587 dated Jun. 7, 2013 (7 pages).
United States Patent Office Supplemental Notice of Allowance for U.S. Appl. No. 29/457,990 dated Sep. 24, 2013 (7 pages).
Co-pending U.S. Appl. No. 29/467,020, filed Sep. 13, 2013.
1st Office Action from The State Intellectual Property Office of the People's Republic of China for Application No. 201310077786.2 dated Jun. 3, 2015 (8 pages).
2nd Office Action from the Patent Office of the People's Republic of China for Application No. 201310077786.2 dated Jan. 21, 2016 (10 pages).
Applicant Response to First Chinese Office Action with English translation in Chinese Patent Application CN 201310077786.2 dated Oct. 16, 2015 (22 pages).
Office Action from the United States Patent and Trademark Office for U.S. Appl. No. 14/080,432 dated Jun. 10, 2016 (10 pages).
3rd Office Action from the State Intellectual Property Office of the People's Republic of China for Application No. 201310077786.2 dated Jul. 25, 2016 (4 pages).

* cited by examiner

FACEPLATE FOR SHOWER DEVICE

RELATED APPLICATIONS

The present application claims priority to co-pending U.S. Provisional Patent Application No. 61/609,793, filed Mar. 12, 2012, the entire contents of which are hereby incorporated by reference.

FIELD

The present invention generally relates to shower devices and, more particularly, to a faceplate for a shower device.

SUMMARY

In one independent aspect, a faceplate assembly for a shower device may generally include a faceplate having front surface and a rear surface, the faceplate being formed at least partially from a transparent material. The rear surface may include a pattern formed from facets, and an opaque layer may be proximate the rear surface. The front surface may be smooth.

In another independent aspect, a faceplate assembly for a shower device may generally include a faceplate having a surface with a pattern of intersecting lines. A plurality of apertures extend through the faceplate to allow water to flow therethrough, and each aperture may be positioned at an associated intersection of lines. The apertures may receive nozzles to allow water to flow therethrough. The pattern may be formed of repeating shapes with edges providing ridges, and each aperture may be formed at an intersection of ridges. The pattern may be formed from changes in thickness of the faceplate.

In yet another independent aspect, a shower device may generally include a faceplate and nozzles for delivering a fluid, the nozzles releasably receiving the faceplate, at least one nozzle being barbed for snap-fitting to the faceplate, the faceplate including apertures for receiving the barbed nozzle(s).

In a further independent aspect, a faceplate assembly for a shower device may generally include a faceplate having a front surface and a rear surface, a plurality of apertures being defined between the front surface and the rear surface, the faceplate being at least partially formed of a transparent material proximate the front surface, and an opaque material located proximate the rear surface. A shower device, such as a handshower, showerhead, etc., may include the faceplate assembly.

In another independent aspect, a faceplate assembly for a shower device may generally include a faceplate having front surface and a rear surface, a plurality of apertures being defined between the front surface and the rear surface; and a pattern formed from facets, adjacent facets meeting at an intersection, at least one of the plurality of apertures being positioned at an intersection. A shower device, such as a handshower, showerhead, etc., may include the faceplate assembly.

In yet another independent aspect, a shower device may generally include a housing defining an inlet for receiving water; a nozzle plate having a surface and including a plurality of nozzles projecting therefrom for discharging water, at least one of the plurality of nozzles having a barb; and a faceplate having a front surface and a rear surface and defining a plurality of apertures therethrough, each of the plurality of nozzles being received in an associated one of the plurality of apertures, the faceplate being snap-fit to the nozzle plate by the barb. The shower device may include a handshower, showerhead, etc.

DETAILED DESCRIPTION

Figure 1:
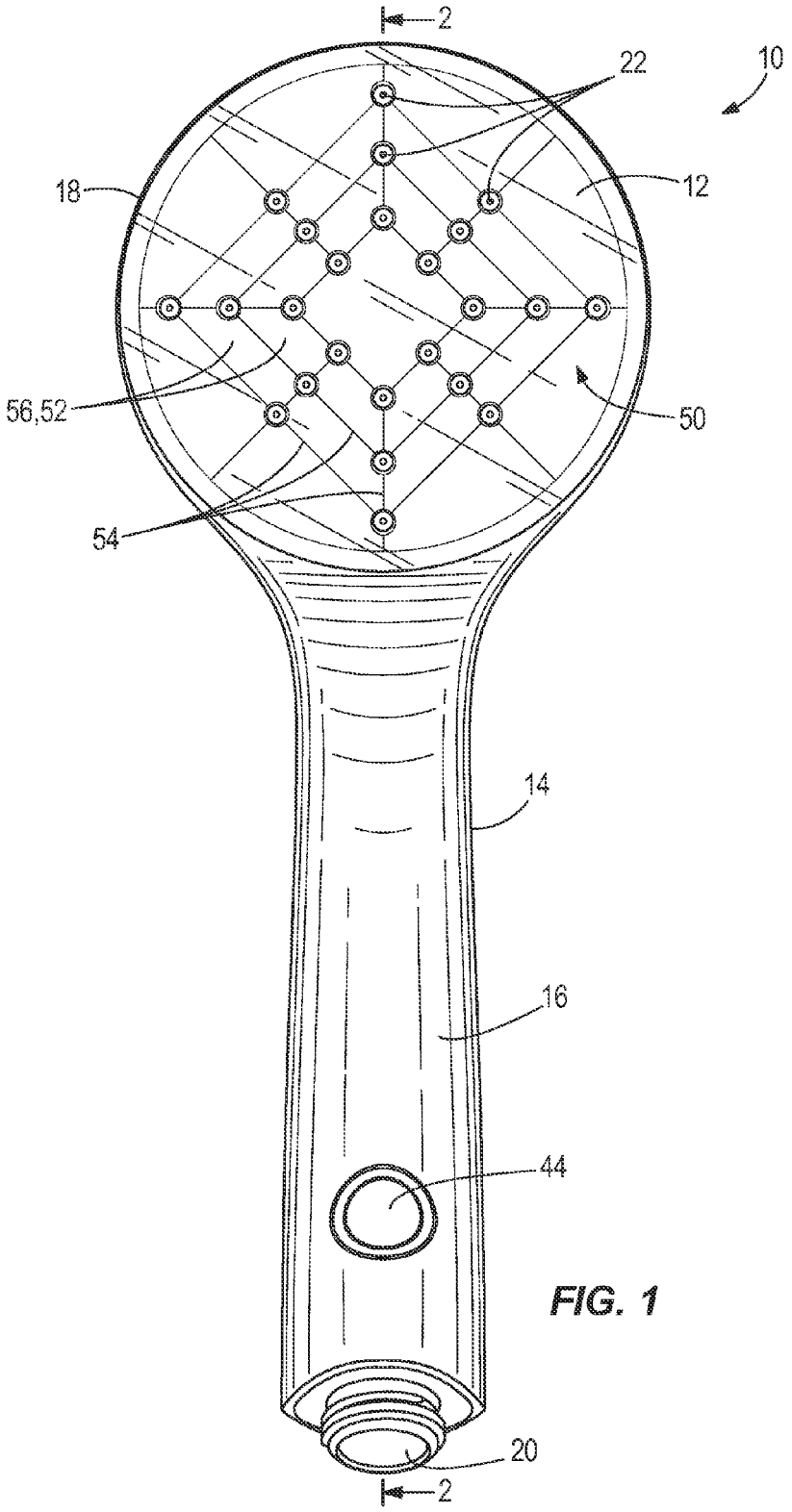
FIG. 1 is a front view of a shower device having a faceplate.
Figure 2:
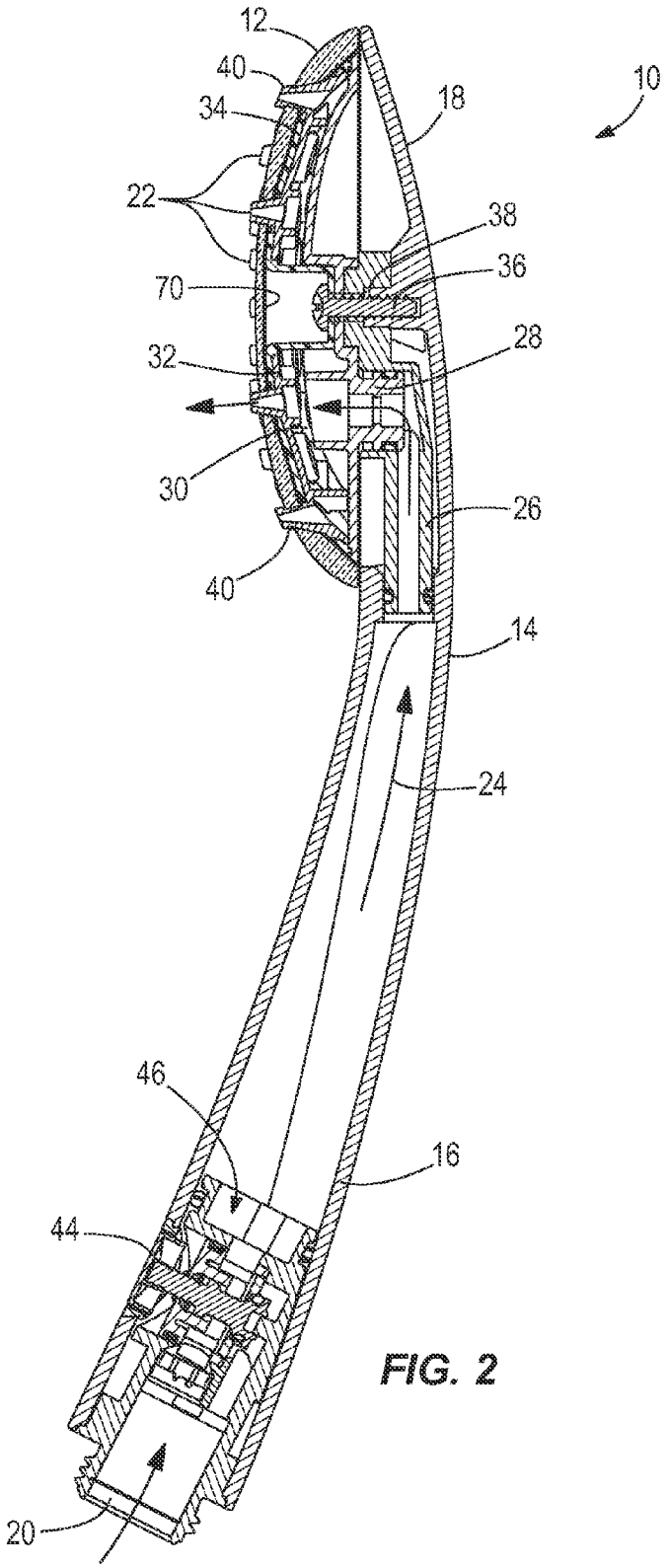
FIG. 2 is a cross-section view of a shower device shown in FIG. 1 taken generally along line 2-2 in FIG. 1.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

A shower device 10, such as a handshower, including a faceplate 12 is shown in FIGS. 1-4. In other constructions (not shown), the shower device 10 may be another device, such as, for example, a showerhead, a rain can, a wall-mounted water tile, etc.

The shower device 10 generally includes a housing 14 having a handle 16 and a head 18, an inlet 20, and a plurality of nozzles 22 forming outlets. The inlet 20 receives a fluid, such as water, and the outlet (e.g., the nozzles 22) discharges the water. A waterway 24 extends between the inlet 20 and the outlet 22 to deliver water from the inlet 20 to the outlet 22.

In the illustrated construction, the waterway 24 is defined by the handle 16, a first waterway member 26, a second waterway member 28, a plenum 30, and the nozzles 22. The nozzles 22 are formed on and protrude from a nozzle plate 32. The illustrated nozzle plate 32 is formed from a single piece of material with the nozzles 22.

The plenum 30 is located between the nozzle plate 32 and the second waterway member 28, and the second waterway member 28 discharges water into the plenum 30 for distribution to the nozzles 22. In other constructions, other arrangements and configurations of parts may form the waterway 24.

A bracket member 34 is positioned between the nozzle plate 32 and the faceplate 12. A fastener 36 passes through the center of the bracket member 34 (and the head 18), through the waterway members 28, 26 and into a boss 38 on an inner surface of the head 18 of the housing 14. Thus, the fastener 36 sandwiches the waterway members 26, 28 between the bracket member 34 and the housing 14 for simple assembly of the shower device 10.

At least some of the nozzles 22 include barbs 40, or undercuts, for receiving the faceplate 12 in a snap-fit manner. The barbs 40 may be formed from annular grooves in the outer periphery of the nozzles 22 or as annular projections proximate the tips of the nozzles 22. The faceplate 12 includes apertures 42 for receiving the nozzles 22 such that the faceplate 12 mates with the barbed nozzles 22 in a snap-fit manner. Sufficient barbed nozzles 22 are provided to retain the faceplate 12. In the illustrated construction, the barbs 40 are resilient to allow the faceplate 12 to be installed and removed without damaging the faceplate 12 or nozzles 22.

In some constructions, the connection between the faceplate 12 and the rest of the shower device 10 is formed solely from the snap-fitting of the faceplate 12 to the nozzles 22. In other constructions, the faceplate 12 may additionally mate with the second waterway member 28, the housing 14 and/or another portion of the shower device 10, by way of an undercut or other coupling mechanism. In yet other constructions (not shown), the faceplate 12 may couple to the shower device 10 by a snap-fit with another component, such as the housing 14, the bracket member 34, etc., instead of with the nozzles 22.

The illustrated shower device 10 includes a "boost" arrangement to selectively increase the water flow. A boost button 44 is positioned on the handle 16, and a valve assembly 46 is positioned in the waterway 24, proximate the inlet 20. A similar boost arrangement (e.g., the boost button 44, the valve assembly 46 and other components) is shown and described in detail in U.S. Provisional Patent Application No. 61/519,357, filed May 20, 2011, the entire contents of which are hereby incorporated by reference.

Figure 3:
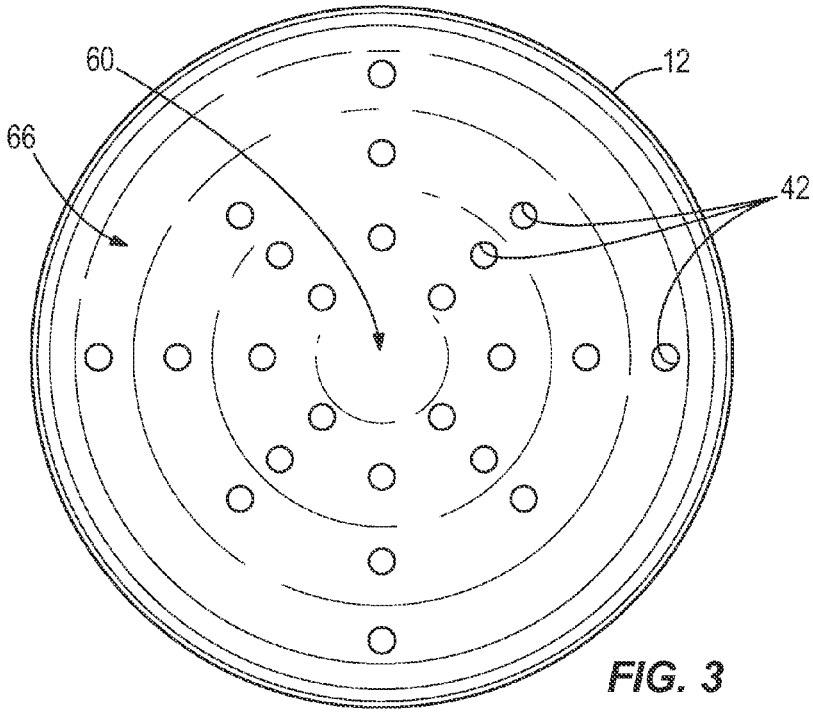
FIG. 3 is a front view of the faceplate shown in FIG. 1, shown as being opaque for the purpose of illustration.
Figure 4:
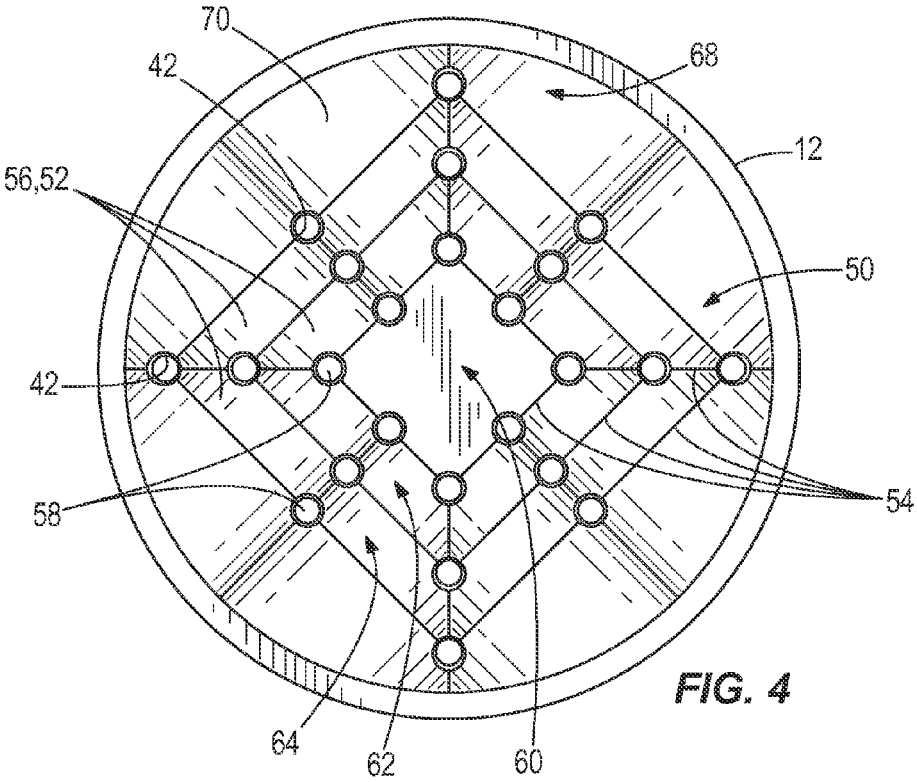
FIG. 4 is a rear view of the faceplate shown in FIG. 3.

As illustrated in FIGS. 3-4, the faceplate 12 has a pattern 50. In the illustrated construction, the pattern 50 is formed by variations in thickness of the faceplate 12 (e.g., facets 52) forming edges 54 and shapes 56 bounded by the edges 54. The edges 54 may be straight or curved. Two adjacent facets 52, or shapes 56, meet at an edge 54. Three or more adjacent facets 52, or shapes 56, meet at an intersection 58 (or intersection point). "Intersection" may generally refer to the location at which adjacent facets 52 meet, such as the edges 54 (e.g., the intersection between two adjacent facets 52) and the intersection points 58 (e.g., the intersection between three or more adjacent facets 52).

The facets 52 may include concave surfaces, convex surfaces, or flat surfaces and may have a variety of shapes (e.g., circle, triangle, square, diamond, trapezoid, polygon, non-polygon, etc.). In the illustrated construction (see FIG. 4), the pattern 50 includes trapezoidal-shaped facets 52. In some constructions, the facets 52 are generally the same (shape, size, etc.), and, in other constructions, the facets 52 are different.

In some constructions, the facets 52 are arranged radially about a center 60 of the faceplate 12. The facets 52 may be arranged in a first group 62 generally at a first radial distance from the center 60 and in a second group 64 generally at a second radial distance from the center 60, etc. The first group 62 includes a first set of facets 52*a*, each having a similar or related shape, size, etc. The second group 64 includes a second set of facets 52*b*, each having a similar or related shape, size, etc. The second facets 52*b* are different than the first facets 52*a* (e.g., different shape, size, etc.). In the illustrated construction, the pattern 50 includes two groups of facets 52*a*, 52*b* of different sizes. In other constructions, the pattern 50 may include only a single group or more than two groups of facets 52.

In some constructions, the pattern 50 of facets 52 may be formed from ridges or grooves in the material of the faceplate 12 forming edges 54 and shapes 56 bounded by the edges 54. In other constructions, the pattern 50 of facets 52 may be painted or printed onto the faceplate 12 (or within the material of the faceplate 12) to form edges 54 and shapes 56 bounded by the edges 54. Other variations for forming the pattern 50 of facets 52 to form edges 54 and shapes 56, or the illusion of edges 54 and shapes 56, may be employed. For example, the pattern 50 of facets 52 may appear to be formed from a plurality of lines that appear to intersect, forming the facets 52 therebetween. Such lines may be straight or curved.

The faceplate 12 has a front surface 66 (FIG. 3) facing away from and a rear surface 68 (FIG. 4) facing toward the waterway 24. The apertures 42 extend between the front surface 66 and the rear surface 68. In the illustrated construction, the pattern 50 is formed on the rear surface 68 (FIG. 4), the front surface 66 is smooth (and curved; FIG. 3), and the faceplate 12 is made from a transparent material (FIG. 1) so that the pattern 50 is visible through the front surface 66, giving the pattern 50 a three-dimensional effect. In other constructions (not shown), the pattern 50 may be formed on the front surface 66 or within the material of the faceplate 12.

In FIGS. 3-4, the faceplate 12 is shown as being opaque to illustrate that the front surface 66 is smooth (and curved). In some constructions (not shown), the front surface 66 may be faceted. In other constructions (not shown), the front and rear surfaces 66, 68 may have corresponding patterns/facets such that the faceplate 12 has a substantially uniform thickness.

The material of the faceplate 12 may be transparent, which includes translucent, cloudy, see-through, clear, etc., so long as some light passes through the faceplate 12, making structure behind the front surface of the faceplate 12 (e.g., the pattern 50) visible from the front (as shown in FIG. 1). An opaque layer 70 is adjacent the rear surface 68. In the illustrated construction, the opaque layer 70 is applied (e.g., painted) on the rear surface 68.

The opaque layer 70 blocks visibility through the faceplate 12 (hiding the fastener 36, the bracket member 34, joints, weldments, or other internal components of the shower device 10). The opaque layer 70 also enhances the appearance of the pattern 50. The opaque layer 70 may be colored or patterned. In some constructions, the opaque layer 70 may have the pattern 50 instead of the faceplate 12.

Figure 7:
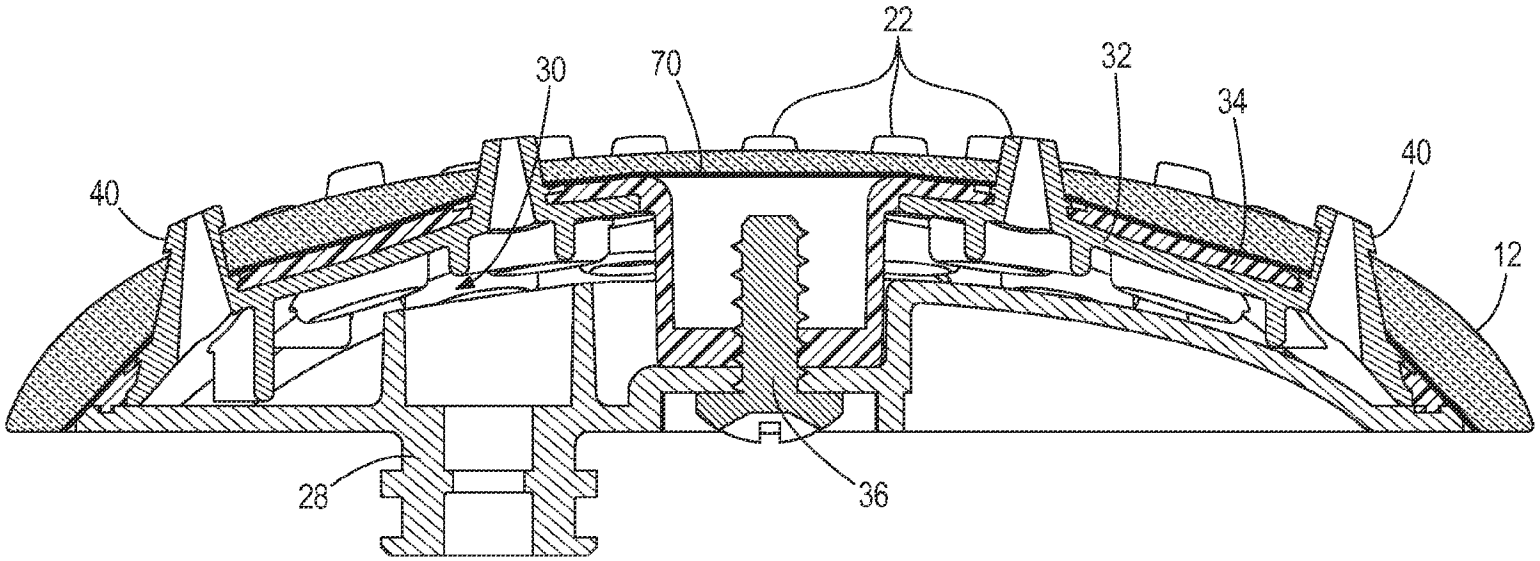
FIG. 7 is a cross-section of a portion of an alternative construction of a shower device.

The opaque layer 70 may be a coating or film on the rear surface 68 of the faceplate 12 (as in the illustrated construction). In some constructions (not shown), the opaque layer 70 may be a member separate from the faceplate 12 and be disposed adjacent the rear surface 68 of the faceplate 12. In other constructions (not shown), the bracket member 34 may provide the opaque layer 70. In such constructions, the fastener 36 may be inserted through the shower device 10 in the opposite direction such that the fastener 36 is not visible through the transparent faceplate 12 (as shown in FIG. 7).

At least some of the apertures 42 for receiving the nozzles 22 are located at intersections 58 of the pattern 50. In the illustrated construction, each aperture 42 is located at an intersection 58. This arrangement may provide for simple and accurate locating of the apertures 42 in the faceplate 12. Formation of apertures 42 at the intersections 58 may help reduce fatigue, stress and/or shear on the nozzles 22 projecting through the apertures 42 when, for example, a force or a torque is applied to the faceplate 12. Furthermore, formation of apertures 42 through the material at the intersections 58 may ensure strength of the faceplate 12. It is not necessary for every intersection 58 of the pattern 50 to include an aperture 42 and a nozzle 22, and it is not necessary for every aperture 42 or nozzle 22 to be positioned at an intersection 58 of the pattern 50.

Figure 5:
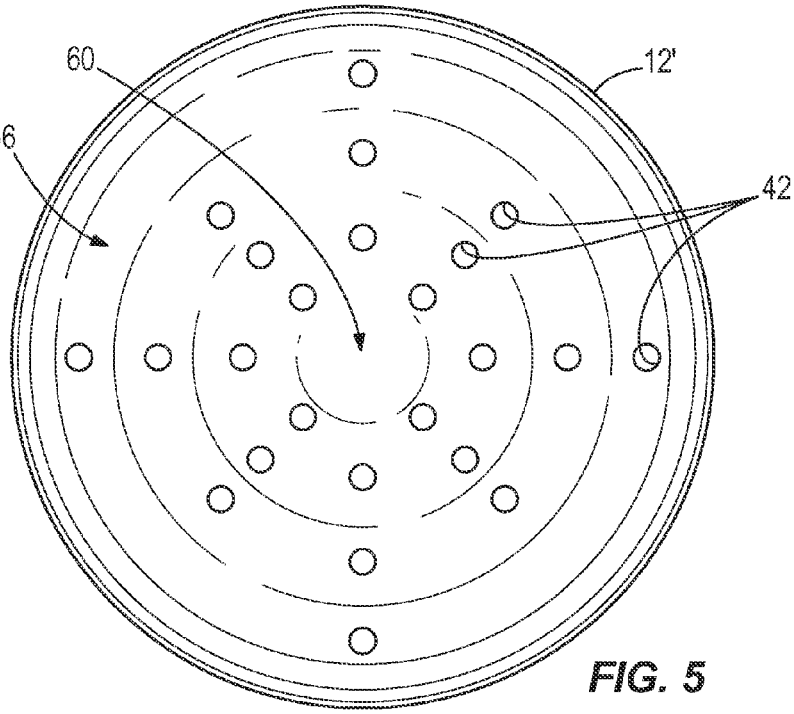
FIG. 5 is a front view of an alternative construction of a faceplate, shown as being opaque.
Figure 6:
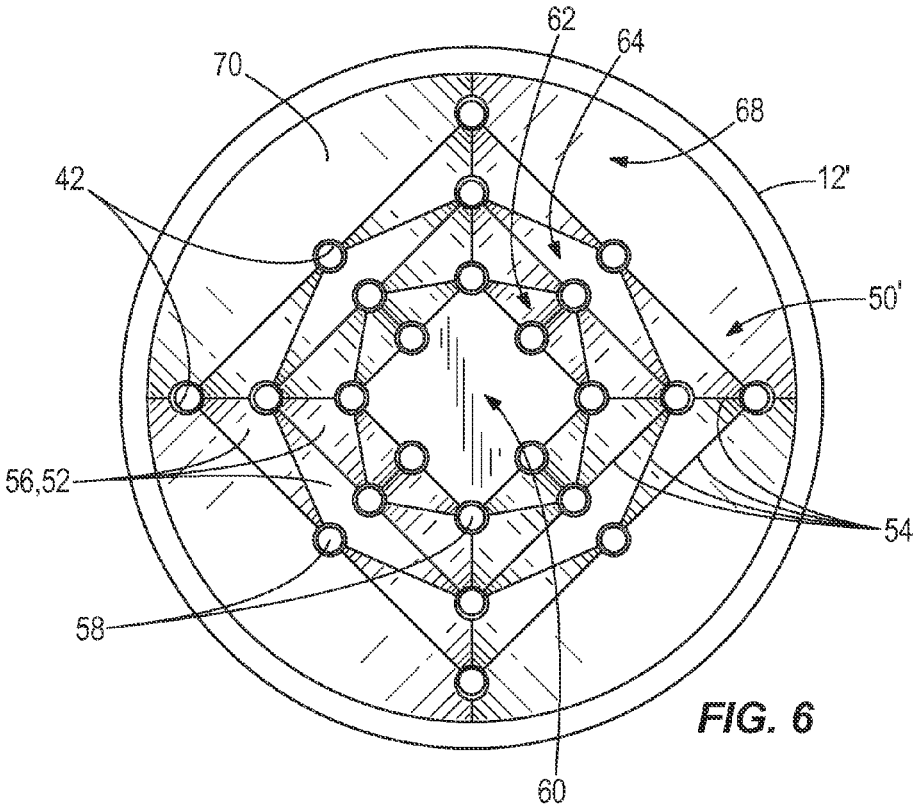
FIG. 6 is a rear view of the alternative construction of the faceplate shown in FIG. 5.

In some constructions, the faceplate 12 is interchangeable with another faceplate, such as the faceplate 12' shown in FIGS. 5-6. For example, the sets of faceplates 12 may include faceplates having the same pattern 50 and different colors, different patterns and the same colors, different patterns and different colors, etc. The sets of faceplates 12, 12' have the same arrangement of apertures 42. In other constructions (not shown), the faceplates may have different arrangements of apertures 42. Sets of faceplates 12, 12' may be provided so that a user may change the appearance of the shower device 10. The interchangeable faceplates 12, 12' also allow a manufacturer, retailer, etc., to provide several models with a minimum number of components (e.g., a common housing 12, waterway 24, etc. attached with each faceplate 12, 12').

FIGS. 5-6 illustrate a faceplate 12' having a pattern 50' different than the pattern 50 shown in FIGS. 1-4. In the illustrated construction, the faceplate 12' has the same arrangement (e.g., number, location, size, etc.) of apertures 42 as that shown in FIGS. 1-4. Furthermore, the pattern 50' has intersections 58 located at substantially the same locations as the pattern 50 shown in FIGS. 1-4. The patterns 50, 50' may share some or all of the same intersections 58.

In other constructions (not shown), the patterns 50, 50' are different, at least some of the intersections 58 are different and at least some of the apertures 42 are positioned differently. In such constructions, a different nozzle plate and bracket member (corresponding to the patterns 50, 50' and apertures 42) may be provided with the remainder of the shower device 10.

The faceplate 12, 12' may be removed by pulling to disengage the snap-fit. Removal of the faceplate 12, 12' may facilitate cleaning of the faceplate 12, 12' and the shower device 10, replacement of the faceplate 12, 12' with a new faceplate or another faceplate having a different color or a different pattern, etc.

Thus, the invention may generally provide a shower device 10 having a faceplate 12. The faceplate 12 may be snap-fit to the nozzles 22 of the shower device 10. The faceplate 12 may have a pattern 50 on the rear surface 68 and be made from a transparent material such that the pattern 50 is visible from the front. The faceplate 12 may include an opaque layer 70 adjacent the rear surface 68. The faceplate 12 may have nozzles 22 positioned at intersections 58 of the pattern 50.

What is claimed is:

1. A faceplate assembly for a shower device, the assembly comprising:

a faceplate having front surface and a rear surface, a plurality of apertures being defined between the front surface and the rear surface; and a pattern formed from facets, adjacent facets meeting at an intersection, at least one of the plurality of apertures being positioned at an intersection.

2. The assembly of claim 1, wherein the pattern is formed from changes in thickness of the faceplate.

3. The assembly of claim 1, wherein the pattern is formed of repeating shapes.

4. The assembly of claim 1, wherein the pattern is located rearwardly of the front surface of the faceplate.

5. The assembly of claim 4, wherein the front surface is smooth.

6. The assembly of claim 1, wherein at least three adjacent facets meet at an intersection point, wherein each of the plurality of apertures is positioned at an associated intersection point.

7. The assembly of claim 6, wherein a thickness of the faceplate material between the front surface and the rear surface is thinner at the intersection point than at a location spaced from the intersection point.

8. The assembly of claim 1, wherein the faceplate is at least partially formed of a transparent material.

9. The assembly of claim 8, wherein the transparent material is proximate the front surface, and wherein the assembly further comprises an opaque material disposed rearwardly of the pattern.

10. The assembly of claim 9, wherein the pattern is formed on the rear surface.

11. The assembly of claim 9, wherein the opaque layer is on the rear surface.

12. A faceplate assembly for a shower device, the assembly comprising:

a faceplate having a front surface and a rear surface, a plurality of apertures being defined between the front surface and the rear surface, the faceplate being at least partially formed of a transparent material proximate the front surface;

an opaque material located proximate the rear surface; and a pattern formed from facets and located rearwardly of the front surface of the faceplate;

wherein, in the pattern, adjacent facets meet at an intersection; and wherein one of the plurality of apertures is positioned at the intersection.

13. The assembly of claim 12, wherein the pattern is formed from changes in thickness of the faceplate.

14. The assembly of claim 12, wherein the pattern is formed of repeating shapes.

15. The assembly of claim 12, wherein the opaque layer is on the rear surface.

16. The assembly of claim 12, wherein the pattern is on the rear surface.

17. The assembly of claim 16, wherein the front surface is smooth.

18. The assembly of claim 12, wherein at least three adjacent facets meet at an intersection.

19. The assembly of claim 18, wherein one of the plurality of apertures is positioned at the intersection.

20. The assembly of claim 18, wherein the faceplate includes a plurality of intersections.

21. The assembly of claim 20, wherein each of the apertures is positioned at an associated intersection.

22. A shower device comprising:

a housing defining an inlet for receiving water;

a nozzle plate having a surface and including a plurality of nozzles projecting therefrom for discharging water, at least some of the plurality of nozzles each having a barb;

a faceplate having a continuous front surface and a rear surface and defining a plurality of apertures therethrough, each of the plurality of nozzles being received in an associated one of the plurality of apertures, the faceplate being snap-fit to the nozzle plate by the barbs; and a pattern formed from facets and located rearwardly of the front surface of the faceplate;

wherein the barbs engage the continuous front surface of the faceplate; and wherein, in the pattern, adjacent facets meet at an intersection, and wherein each of the plurality of apertures is positioned at an associated intersection.

23. The shower device of claim 22, wherein the faceplate is formed at least partially from a transparent material.

24. The shower device of claim 23, further comprising an opaque layer proximate the rear surface of the faceplate.

25. The shower device of claim 22, wherein the rear surface of the faceplate includes the pattern.

26. The shower device of claim 22, wherein the pattern is formed from changes in thickness of the faceplate.

27. The shower device of claim 22, wherein the pattern is formed of repeating shapes.

28. The shower device of claim 22, wherein the front surface of the faceplate is smooth.

29. The shower device of claim 22, wherein the shower device includes a handshower.

30. The shower device of claim 29, further comprising:

a handle; and a waterway connected between the inlet and the nozzles, the waterway being supported in the handle.

31. A faceplate assembly for a shower device, the assembly comprising:

a faceplate having a front surface and a rear surface, a plurality of apertures being defined between the front surface and the rear surface, the faceplate being at least partially formed of a transparent material proximate the front surface;

an opaque material located proximate the rear surface; and a pattern formed from facets and located rearwardly of the front surface of the faceplate;

wherein at least three adjacent facets meet at an intersection; and wherein one of the plurality of apertures is positioned at the intersection.

32. The assembly of claim 31, wherein the faceplate includes a plurality of intersections.

33. The assembly of claim 32, wherein each of the apertures is positioned at an associated intersection.

34. The assembly of claim 31, wherein the pattern is formed from changes in thickness of the faceplate.

35. The assembly of claim 31, wherein the pattern is formed of repeating shapes.

36. The assembly of claim 31, wherein the opaque layer is on the rear surface.

* * * * *